United States Patent [19]

Furutsu

[11] Patent Number: 4,683,920

[45] Date of Patent: Aug. 4, 1987

[54] BANDING MACHINE

[75] Inventor: Akira Furutsu, Tokyo, Japan

[73] Assignees: Japan Bano'k Co., Ltd., Tokyo, Japan; Ben Clements & Sons, Inc., South Hackensack, N.J.

[21] Appl. No.: 808,398

[22] Filed: Dec. 12, 1985

[30] Foreign Application Priority Data

Jan. 16, 1985 [JP] Japan ..... 60-4049
Mar. 29, 1985 [JP] Japan ..... 60-63254

[51] Int. Cl.[4] ..... B21F 15/04
[52] U.S. Cl. ..... 140/93 A
[58] Field of Search ..... 140/93 A, 93.2

[56] References Cited

U.S. PATENT DOCUMENTS 3,621,889 11/1971 Hidassy ..... 140/93.2
4,359,070 11/1982 Hidassy et al. ..... 140/93.2

*Primary Examiner*—Lowell A. Larson
*Attorney, Agent, or Firm*—Blum Kaplan

[57] ABSTRACT

The invention relates to a banding machine for banding linear objects through a banding element having engageable male and female members on both ends, which includes a retractable member which prevents drift of the banding element provided in the neighborhood of a leading end portion of a banding-element carrying passage provided in the banding machine, which prevents the banding element from drifting when it is being fed laterally or at the beginning of a banding operation, and a biased arm which supports the banding element, disposed in the banding-element carrying passage, which supports the banding element in the course of being laterally fed.

3 Claims, 28 Drawing Figures

BANDING MACHINE

BACKGROUND

The present invention relates to a banding machine and, more particularly, a banding machine which ensures accurate banding.

For banding a plurality of linear bodies, for example by means of a strap-type banding element, the prevailing method is such that the banding element is first folded into two to hold the linear bodies therein between the folded-over portions thereof, and locking parts at the ends of the banding element are then engaged with each other. However, the existing banding machines sometimes fail to operate accurately due to wrongly folding the banding element.

Upon banding, while the banding element is fed transversely into a banding-element carrying passage in the banding machine, it often falls through the clearance of the carrying passage. It is highly troublesome to extract the banding element out of the clearance because the banding machine must then be disassembled.

Further, if the clearance of the carrying passage is narrowed to prevent the banding element from falling therein, then the thickness of a jig for bending the banding element should necessarily be limited accordingly, to result in a decrease in the strength of the jig.

SUMMARY

An object of the invention is to obviate the above indicated difficulties in the cases of existing banding machines and, more concretely, to minimize banding failure caused by the banding element being folded wrongly.

Another object is to prevent the banding element from falling into the banding machine when it is fed transversely into the banding-element carrying passage.

In order to attain the above objects, the invention proposes to provide prevention means with which to prevent the banding element from drifting, near a leading end portion of the banding-element carrying passage provided in the banding machine.

Further, according to the invention means is disposed in the carrying passage for supporting the banding element being transversely fed.

DRAWINGS

THE PREFERRED EMBODIMENTS

A banding element will be described first before entering a description of the preferred embodiments of the present invention.

Figure 24:
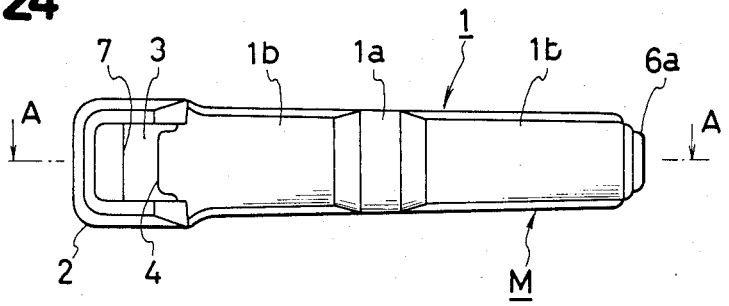
FIG. 24 is a top plan view of a banding element.

A banding element M is formed of a synthetic resin as a one-body device. As shown in FIG. 24, a strap body 1 has a reduced thickness part 1*a* in a longitudinally central part thereof and a thicker part 1*b* on each side thereof.

One thicker part 1*b* has an engaging hole 3 surrounded by an annular part 2 on an end portion, and a push piece 4 and an edge portion 7 are formed across the engaging hole 3.

Figure 25:
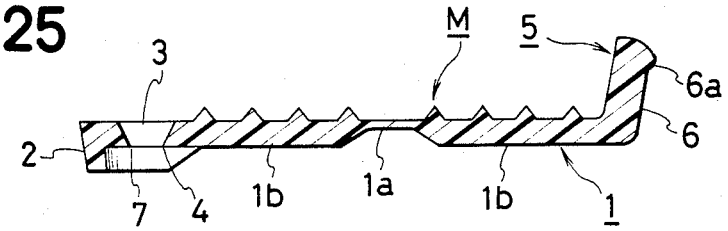
FIG. 25 is a sectional view taken on line A—A of FIG. 24.
Figure 26:
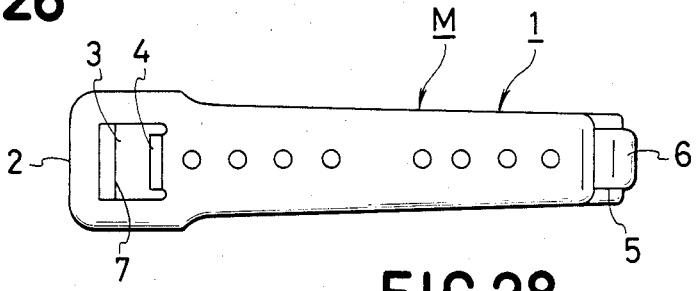
FIG. 26 is a bottom plan view of the banding element.

The other thicker part 1*b* has a head 5 working as an engaging member to be inserted in the engaging hole 3 on the end portion as shown in FIG. 25. The head 5 is formed of a hooked projection 6 projecting from the thicker part 1*b*, and a hook part 6*a* on a nose of the projection 6 is engageable with the edge portion 7 at the time of banding. Then, as shown in FIG. 26, the strap body 1 gradually decreases in width toward the head 5 from the annular part 2, which is ready for bending in a banding machine described hereinlater.

Figure 27:
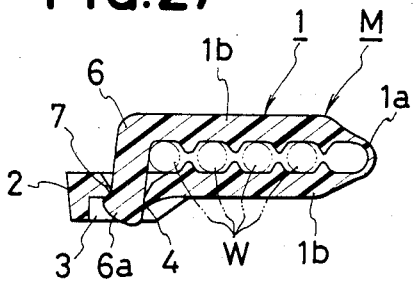
FIG. 27 is a sectional view, showing a condition in which linear objects have been banded by the banding element.

FIG. 27 shows a banding state of the banding element M, wherein the strap body 1 is bent through the reduced thickness part 1*a* to catch a linear bundle W between the two thicker parts 1*b*, 1*b*, the projection 6 is inserted in the engaging hole 3, and the hook part 6*a* of the projection is engaged with the edge portion 7 of the engaging hole, thereby banding the bundle W.

Figure 28:
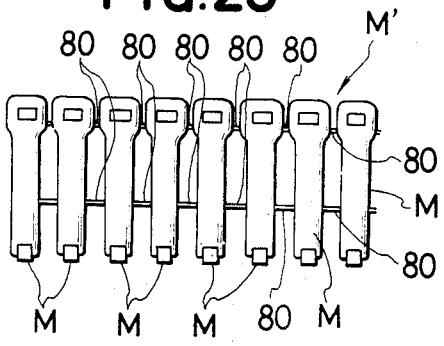
FIG. 28 is a plan view of a banding element assembly.

FIG. 28 indicates an assembly M′ of the banding elements M, and each banding element M is coupled in parallel through a filament coupling member 80. The assembly M′ is formed integrally of a synthetic resin.

Next, a banding machine of the present invention will be described.

Figure 1:
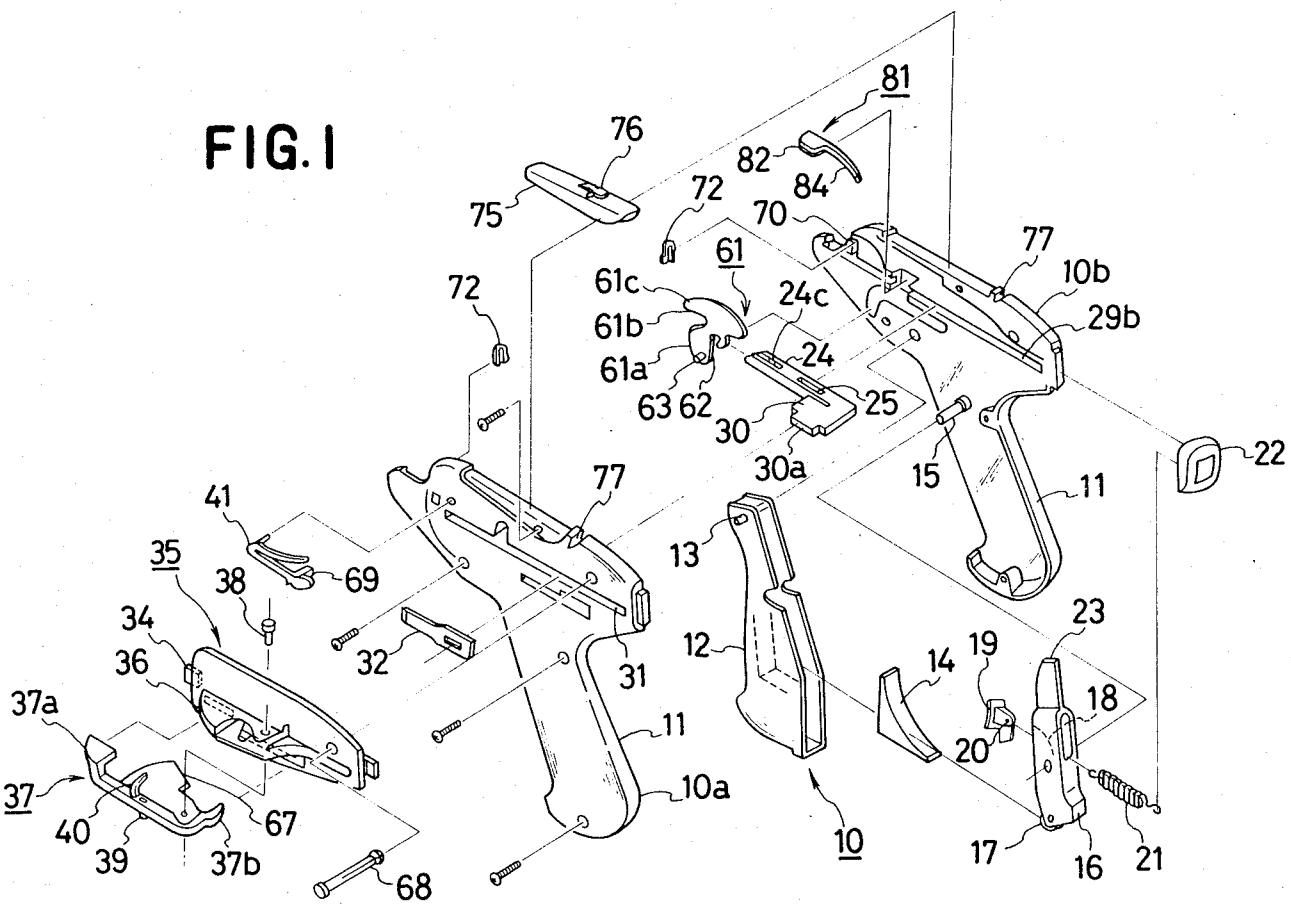
FIG. 1 is an exploded view of a banding machine according to the present invention.

The main frame of a banding machine 10 is constituted of two pistol-like bodies 10*a* and 10*b*, left and right respectively as shown in FIG. 1, and an operating lever 12 is journaled in an opening portion coming ahead of a grip 11 through a shaft 13. The operating lever 12 is U-shaped in section, and a guide 14 is fixed in the interior thereof.

Figure 2:
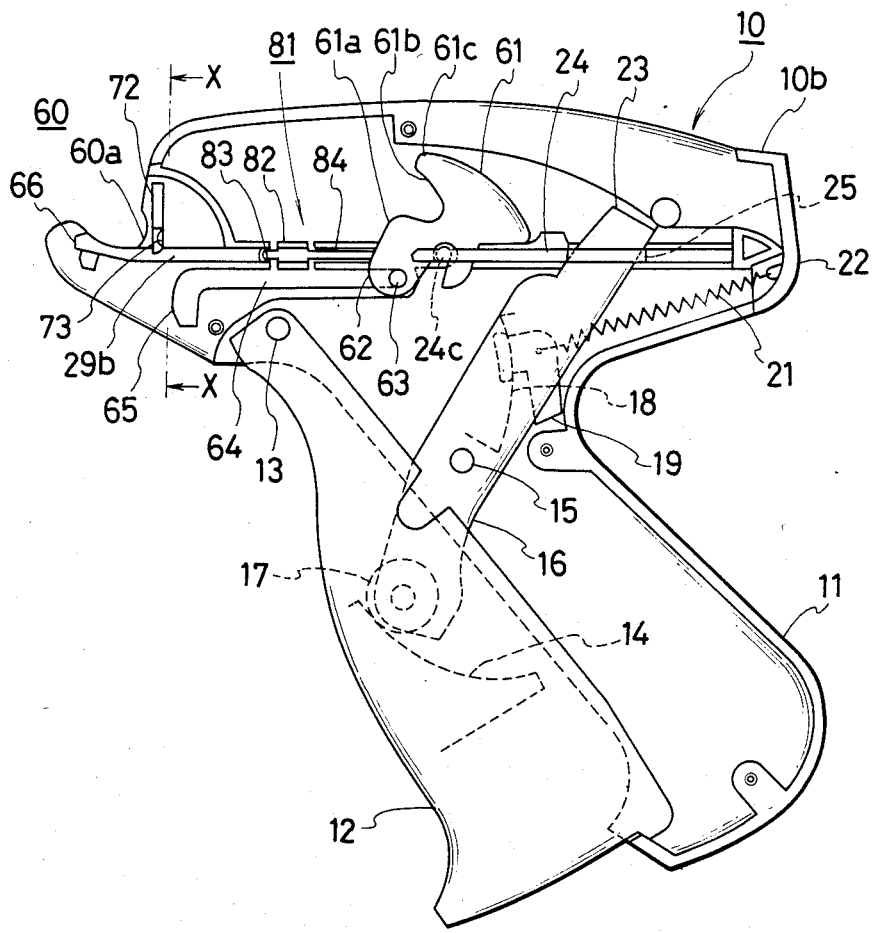
FIG. 2 is a side elevational view of a part of the banding machine according to the invention.

A lever 16 is journaled in the grip 11 almost at the center through a shaft 15 as shown in FIG. 2. A roller 17 mounted on an end portion of the lever 16 comes in contact with the guide 14, and the lever 16 can be shaken along the longitudinal axis of the banding machine 10 through the operating lever 12. The lever 16 has a guide face 18 formed toward the operating lever 12. A bracket 19 is mounted slidably on the guide face 18. Further, a return spring 21 is bridged between the bracket 19 and a cap 22 fitted in a rear opening of the banding machine 10. The bracket 19 moves toward the shaft 15 along the guide face 18 when the lever 16 is inclined forward of the banding machine 10, thereby preventing operator fatigue.

Then, a pusher member 24 is disposed in first guide grooves 29*a*, 29*b*, working as a banding element carrying path, which are provided inside the bodies 10*a*, 10*b*. An upper end portion 23 of the lever 16 is inserted in an elongated aperture 25 of the pusher member 24, and the pusher member 24 is reciprocated longitudinally of the banding machine 10 by the lever 16. The first guide grooves 29*a*, 29*b* are separated left and right according to a passage 55 through which the upper end portion 23 of the lever 16 passes.

Figure 7:
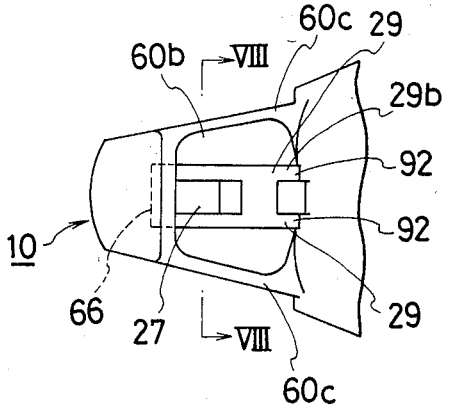
FIG. 7 is a plan view of the leading end portion of the banding machine according to the invention.

Lower surfaces 92 of the first guide grooves 29*a*, 29*b* join together at the leading end portion as shown in FIG. 7, thus constituting a wide guide groove 29.

Further, as shown in FIG. 2, a bent lever 61 is provided elevatingly back and forth on a shaft 24*c* provided in front of the pusher member 24. A pin 63 fixed on an extension 62 of the bent lever 61 is fitted in a second guide groove 64 provided on a lower side of the first guide groove 29.

The second guide groove 64 is curved downward at the leading end portion to form a bend 65. The bend 65 guides the pin 63 downward to turn the bent lever 61 forward. Then, when the pusher member 24 moves further forward with the pin 63 stopping around a nose of the bend 65, the bent lever 61 rotates counterclockwise.

The bent lever 61 is provided with a guide surface 61*a* for raising the head 5 of the banding element M, a bent surface 61*b* for folding the thicker part 1*b* on a side of the head 5 of the banding element M toward the annular part 2, and a leading end portion 61*c* for inserting the head 5 of the banding element M into the engaging hole 3.

On the other hand, the banding machine 10 is provided with a bearer 60 to place the linear bundle W thereon at the nose portion. The bearer 60 has an ascending part 60*a*, which is effective in keeping the linear bundle W on the bearer 60 from coming rearward of the banding machine 10 from the reduced thickness part 1*a* of the banding element M when the banding element M runs against a stopper 66 on the leading end of the first guide grooves 29*a*, 29*b*.

Figure 8:
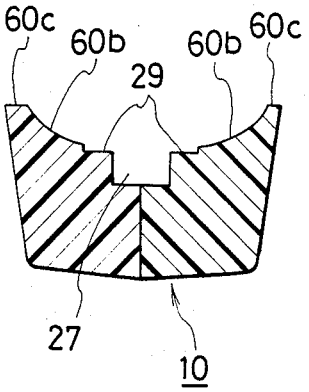
FIG. 8 is a sectional view taken on line VIII—VIII of FIG. 7.

Then, as shown in FIG. 7, the bearer 60 is provided with a recession 60*b* broader than the guide groove 29, and a support part 60*c* for supporting the linear bundle W thereon is provided on both left and right portions of the recession 60*b* as shown in FIG. 8. Further, a deep groove 27 for allowing the head 5 of the banding element M to come out is provided on a bottom of the guide groove 29.

Figure 6:
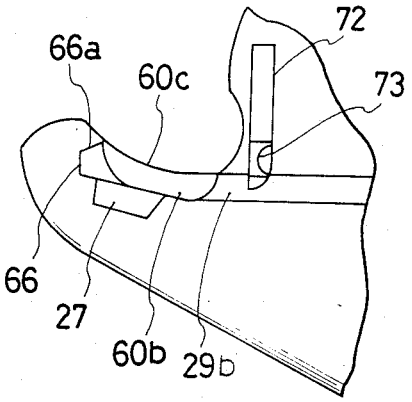
FIG. 6 is a side elevational view of a leading end portion of the banding machine according to the invention.

Furthermore, the stopper 66 for stopping the banding element M is provided on a leading end portion of the first guide groove 29 as shown in FIG. 6. With the upper surface 66*a* projecting rearward of the first guide groove 29, the stopper 66 functions to prevent the banding element M from flying out.

An extension 30 provided laterally from the pusher member 24 is inserted, as will be understood from FIG. 1, in a cross hole 31 provided on the left body 10*a*. Then, a blade 32 is mounted on a projection 30*a* formed on the nose thereof, thereby cutting the banding elements M, one by one, off the assembly M′ in accordance as the pusher member 24 moves forward. The cross hole 31 constitutes one part of the first guide groove 29*a*.

As shown in FIG. 1, furthermore, there is a feed part 35 of the assembly M′ mounted on a side of the left body 10*a*. The feed part 35 is provided with a guide part 36 rectangular to a side of the body 10*a*, and a banding element feeder 37 is provided on a lower portion of the guide part 36 so as to interlock with the pusher member 24 on a pin 38. The feed part 35 is fitted on the body 10*a* by a projection 34 provided on the front and is also fixed on the body 10*a* by a pin 68.

Further, the lever 16 slides with a side 67 of the banding element feeder 37, and thus projects a feed piece 37*a* on the nose of the banding element feeder 37 outwardly of the body 10*a* or comes in contact with a hook part 37*b* to push the feed piece 37*a* into the body 10*a*.

Then, the banding element feeder 37 is provided with a feed claw 40 and a release lever 39, and the feed claw 40 is disengaged from the assembly M′ by the release lever 39.

Figure 9:
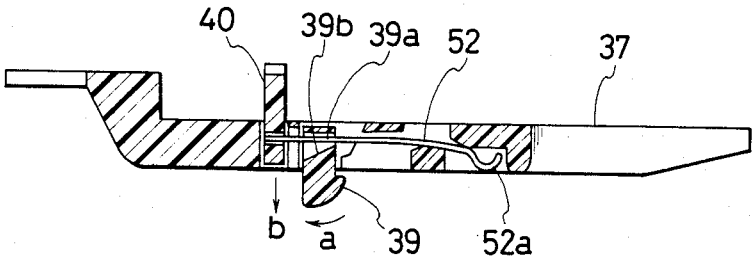
FIG. 9 is a sectional view of essential parts of a banding element feeder.

As shown in FIG. 9, the release lever 39 and the feed claw 40 are supported on a leaf spring 52 fixed on the banding element feeder 37. The release lever 39 is positioned on the side of a head 52*a* of the leaf spring 52 against the feed claw 40, and if the release lever 39 is pushed as indicated by an arrow (a), then a free end of the leaf spring 52 comes downward, therefore the feed claw 40 is drawn downward of the banding element feeder 37 as indicated by an arrow "b". A hole 39*a* provided in the release lever 39 has the lower surface 39*b* inclined so as not to obstruct the leaf spring 52.

Further, as will be understood from FIG. 1, a detent 41 is mounted on the body 10*a* so that a projection 69 will project into the feed path of the banding element M, thereby functioning as a backstop so as not to allow the banding element M retained on a support means 81 described hereinlater to slip back after it has been fed.

Figure 10:
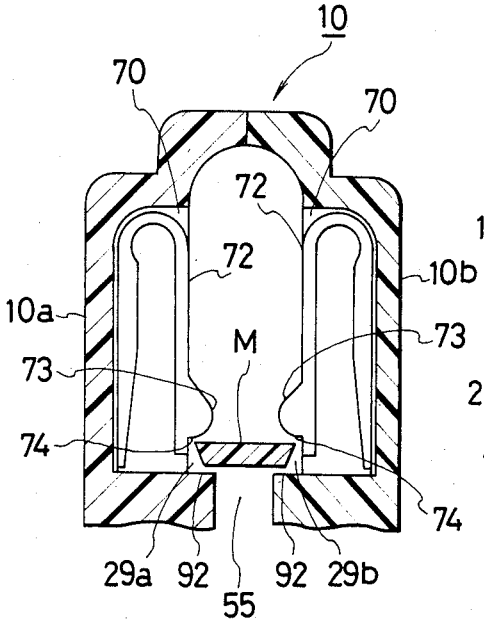
FIG. 10 is a sectional view taken on line X—X of FIG. 2.

As shown in FIG. 10, furthermore, a projection 73 as a means for preventing drift of the banding element M is disposed over the first guide grooves 29*a*, 29*b* each. Each projection 73 is almost parabolic in shape viewed from the front and is fixed near a lower end portion of a U-shaped body 72 having a spring force. Each projection 73 has a horizontal notch 74 partly at the lower portion, and the notch 74 is positioned on an extension of the upper surface 93 of the first guide grooves 29*a*, 29*b*. A limited space between the lower surface 92 of the first guide grooves 29*a*, 29*b* and the notch 74 may hinder conveyance of the banding element M, but if it is excessively wide, the banding element M cannot be prevented from drifting when the banding element M is carried or when banding begins. Each body 72 is fitted in a recession 70 provided on the bodies 10*a*, 10*b*.

Each projection 73 is disposed at a spot at a constant distance from a nose of the guide groove 29. That is, the projection 73 is disposed almost at a position of the reduced thickness part 1*a* of the banding element M when a leading end of the banding element M reaches a portion of the stopper 66 on the nose of the guide groove 29. Then, it can be positioned somewhat backward from the position of the reduced thickness part 1*a* of the banding element M. Further, the projection 73 can be formed so as to prevent drift of the banding element M.

Figure 3:
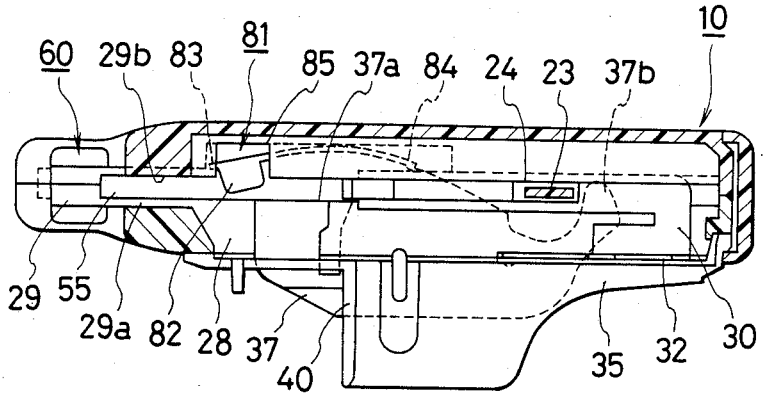
FIG. 3 is a sectional view of the banding machine according to the invention.
Figure 4:
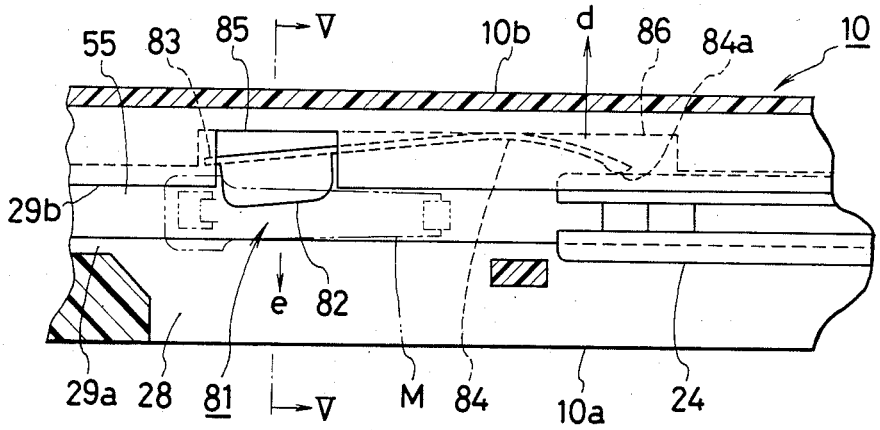
FIG. 4 is an enlarged view, showing essential portions of FIG. 3.
Figure 5:
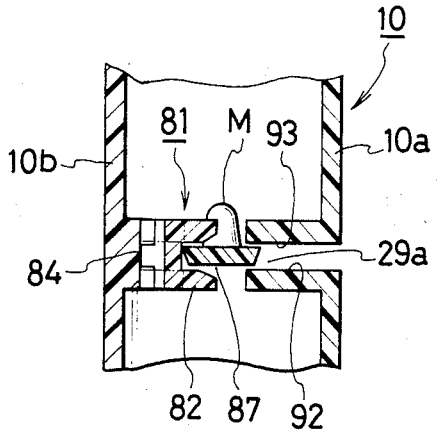
FIG. 5 is a sectional view taken on line V—V of FIG. 4.

The support means 81 for preventing the banding element M from coming down is disposed in a path of the first guide groove 29*b*, as shown in FIG. 3. The support means 81 is constituted, as shown in FIG. 4, of a head 82, a projection 83 fixed on a front end of the head 82 and an almost J-shaped spring 84 fixed on a rear end of the head 82. The head 82 of the support means 81 is inserted in a groove 85 provided on a part of the first guide groove 29*b*, and the projection 83 and the spring 84 of the support means 81 are inserted in a deep groove 86 for which the first guide groove 29*b* is partly deepened. The head 82 of the support means 81 is recessed in cross section, as shown in FIG. 5, like the first guide groove 29*b*, and its groove part 87 is ready for holding the banding element M. Further, the groove part 87 is provided so as not to cause a difference in level with the first guide groove 29*b*, thus smoothing the way for the banding element M.

Then, as shown in FIG. 4, when a rear end 84*a* of the spring 84 is pushed by an edge of the pusher member 24 in the direction indicated by an arrow "d", the head 82 of the support means 81 moves rapidly toward the guide groove 29*a* as indicated by an arrow "e". Then, when the pusher member 24 moves forward, the head 82 of the support means 81 is pushed by a side of the bent lever 61 to retreat into the groove 85, thus smoothing the way for the bent lever 61.

The head 82 of the support means 81 is disposed at a spot opposite to the feed piece 37*a* of the banding element feeder 37, thus holding the banding element M in so that it may quickly be fed laterally.

Figure 11:
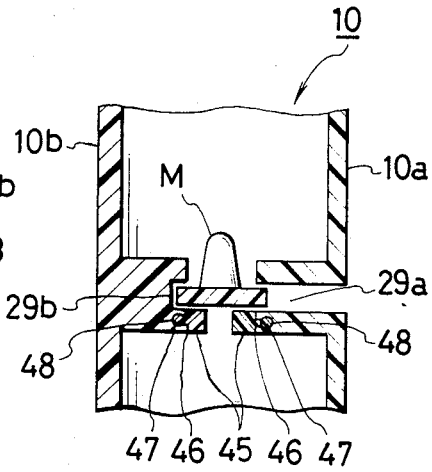
FIG. 11 is a sectional view of modified example of the banding element support means.

Then, as shown in FIG. 11, a tongue-shaped holding member 45 formed of a flexible member such as rubber, synthetic resin or the like is mounted on a lower side edge 46 of the first guide grooves 29*a*, 29*b* each, and the holding members 45, 45 may function as holding the banding element M in crossfeed. Each holding member 45 is ready for operation by having the fixed part 47 pushed into a groove 48 provided on each edge 46 of the guide groove.

Figure 23:
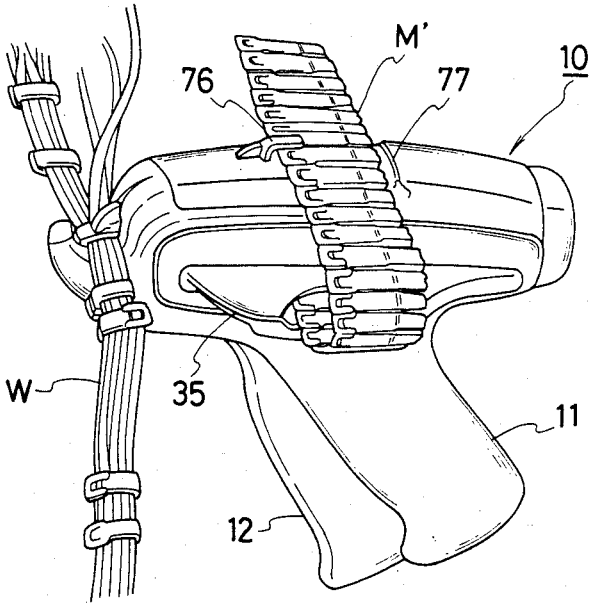
FIG. 23 is a perspective view, showing a condition in use of the banding machine according to the invention.

A guide 76 for supporting the assembly M′ is provided on a cover 75 mounted on the top of the banding machine 10 as shown in FIG. 1, and a passage 77 for allowing the projection 6 of the banding element M to pass is provided on the banding machine bodies 10*a*, 10*b*. Then as shown in FIG. 23, from supporting a free end of the assembly M′ of the banding elements M on the guide 76, the assembly M′ will not be a hindrance to the operation.

Next, a banding motion of the banding machine will be described.

(a) Charging of the Banding Elements

Figure 12:
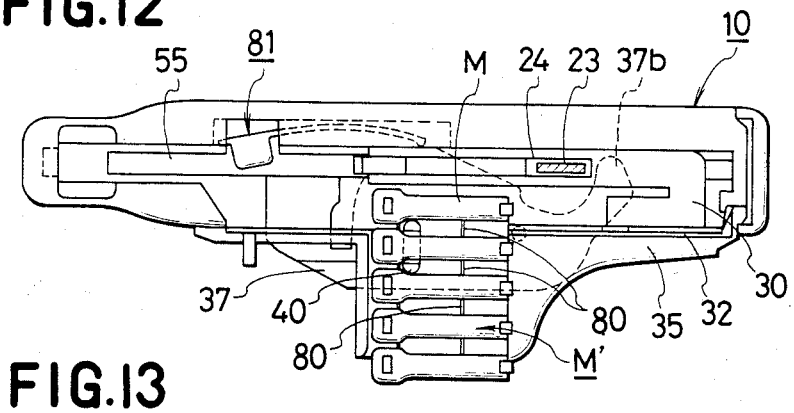
FIG. 12 to FIG. 20 are views, explanatory of various operation conditions of the banding machine according to the invention.

First, as shown in FIG. 12, the banding element assembly M′ is installed on the feed part 35.

From drawing the operating lever 12 next, the blade 32 moves forward toward a front end of the banding machine 10 together with the pusher member 24. Then, the coupling part 80 of the assembly M′ is cut with the blade 32, and the foremost end banding element M is separated from the assembly M′.

Figure 13:
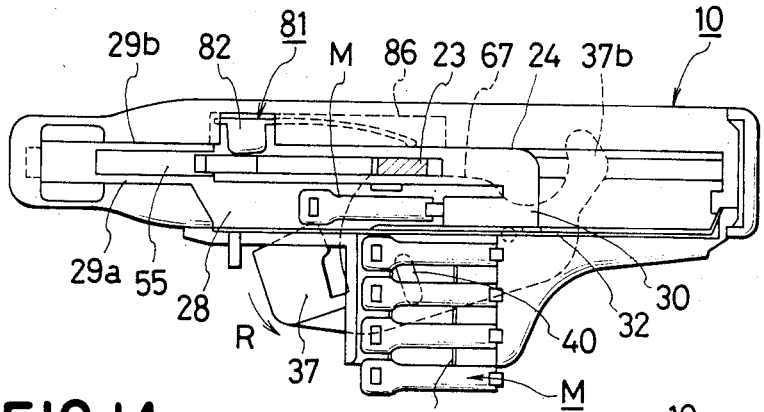
Figure 14:
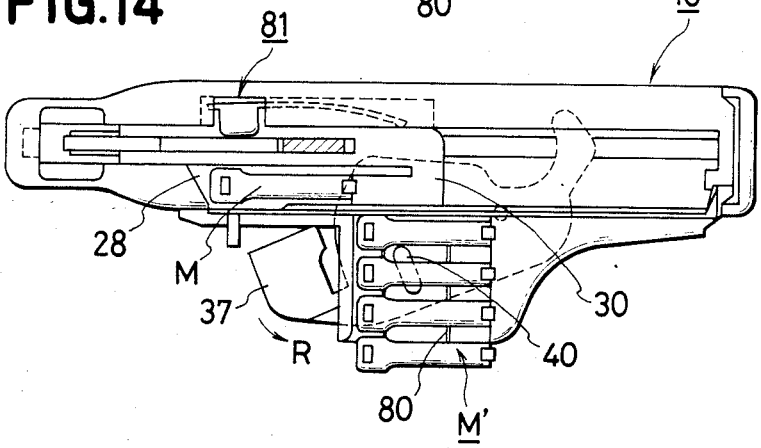

When the pusher member 24 goes forward successively, the banding element M is fed forward, as shown in FIG. 13, by the extension 30 of the pusher member 24. Finally, the banding element M is fed into a stand-by groove 28 communicating with the first guide groove 29*a*, as shown in FIG. 14.

On the other hand, the lever 16 comes to slide with the side 67 of the banding element feeder 37 through triggering operation of the operating lever 12, and the banding element feeder 37 rotates, as shown in FIG. 13, in the direction indicated by an arrow R. Then, the head 82 of the holding means 81 is pushed into the deep groove 86 by the pusher member 24.

Figure 15:
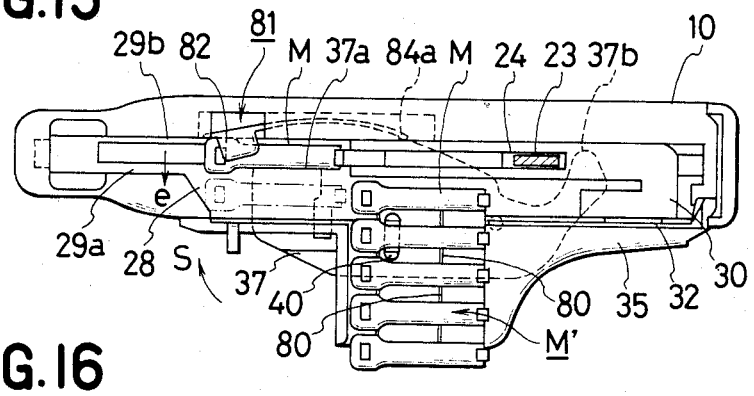

Next, if the force which triggers the operating lever 12 is loosened to reset the operating lever 12, the head 82 of the holding means 81 protrudes, as shown in FIG. 15, from the first guide groove 29*b* in the direction indicated by an arrow "e" according as the pusher member 24 is reset.

Next, since the lever 16 pushes the hook part 37*b* of the banding element feeder 37 clockwise, the banding element feeder 37 rotates in the direction indicated by an arrow S. Then, the banding element M in the stand-by groove 28 is fed laterally by the feed piece 37*a* in the direction of the holding means 81 and retained on the head 82 of the holding means 81. The feed piece 37*a* is positioned on the side of the banding element M to support the side at the end of a rotation of the banding element feeder 37 in the direction indicated by the arrow S.

In this case, the feed claw 40 protrudes between the assemblies M′ to prepare for the next feed.

(b) Delivery of the Banding Elements

Figure 16:
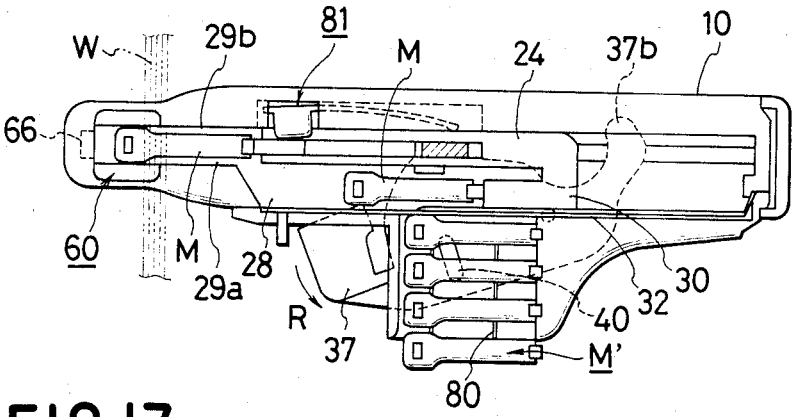
Figure 17:
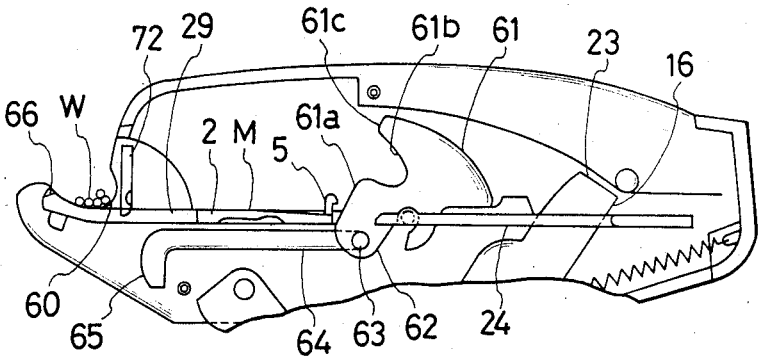
Figure 21:
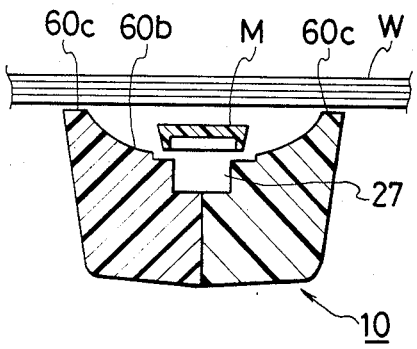
FIG. 21 is a view, showing a condition in which a banding element is fed under linear objects to be bundled.

As shown in FIG. 16, when the material to be banded W is placed on the bearer 60 and then the operating lever 12 is drawn again, the banding elements M are fed forward by the pusher member 24. Then, the banding element M runs against the stopper 66 provided on the nose of the guide groove 29 and stops. In this case, the banding element M is positioned, as shown in FIG. 21, under the linear bundle W.

Figure 18:
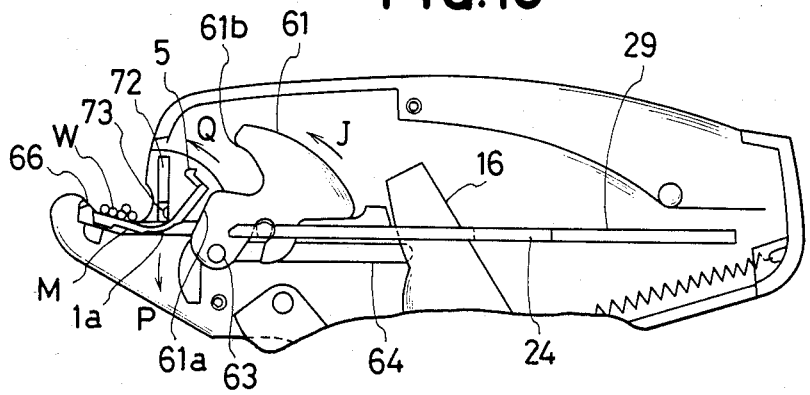

Further, if the operating lever 12 is held back, the pusher member 24 continues to go forward notwithstanding that the banding element M is kept from moving further by the stopper 66, therefore the pin 63 provided on the bent lever 61 moves within the bent 65, as shown in FIG. 18, in the direction indicated by an arrow P.

Further, when the pusher member 24 goes forward, the bent lever 61 rotates in the direction indicated by an arrow J, and thus the head 5 of the banding element M is lifted by the guide surface 61*a* in the direction indicated by an arrow Q.

In this case, the reduced thickness part 1*a* of the banding element M is prevented from floating by the projection 73 working as a floating prevention, therefore the head 5 of the banding element M begins to bend from a portion of the reduced thickness part 1*a*.

Then, when moving forward within the first guide grooves 29*a*, 29*b*, the banding element M is prevented from floating by the projection 73.

On the other hand, as shown in FIG. 16, the banding element feeder 37 turns again in the direction indicated by an arrow R according as the pusher member 24 goes forward. Then, the banding element M positioned already at the extreme nose of the assembly M′ is cut with the blade 32 and extruded toward the stand-by groove 28 by the extension 30 of the pusher member 24.

(c) Bending Operation

Figure 19:
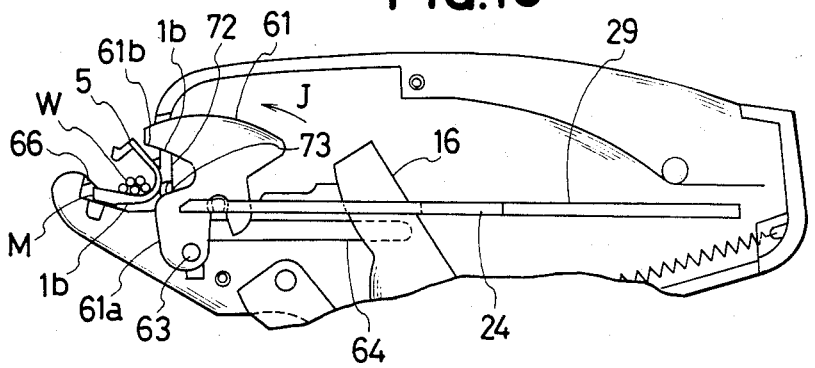

When the pusher member 24 moves further forward, the bent lever 61 further rotates in the direction indicated by the arrow J as shown in FIG. 19, and the banding element M is bent forward on a side of the head 5 by the bent surface 61*b*. Then, the material to be bundled W is caught between the two thicker parts 1*b*, 1*b*.

In this case, the banding element M comes off the projection 73, however, the projection 73 retracts once left and right and is then returned to an original state by the spring force.

(d) Banding Operation

Figure 20:
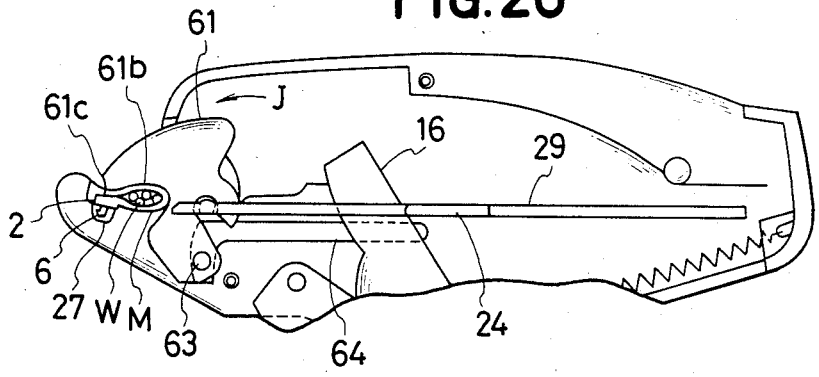

As shown in FIG. 20, when the pusher member 24 goes further forward, the bent lever 61 rotates further in the direction indicated by the arrow J, the projection 6 provided on the head 5 of the banding element M is inserted in the engaging hole 3 of the annular part 2 by the leading end portion 61*c*, and the hook part 6*a* of the projection engages the edge portion 7.

Figure 22:
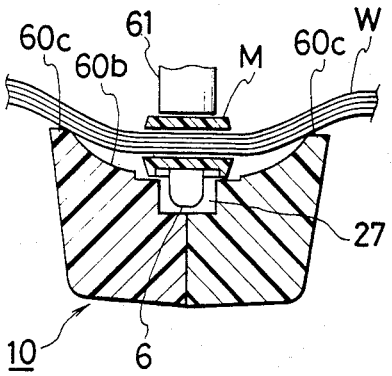
FIG. 22 is a view, showing a condition in which the linear objects are being bundled.

When the banding element M is pushed by the bent lever 61 for banding, the linear bundle W is drawn into the recession 60*b* as shown in FIG. 22, therefore the head 5 of the banding element M is ready to come into the engaging hole 3.

In this case, the banding element M used for the next banding is fed into the stand-by groove 28.

(e) Return Operation

Upon releasing a triggering motion of the operating lever 12, the pusher member 24 returns to the initial state. Then, whenever the pusher member 24 is reset, the banding element M in the stand-by groove 28 is fed laterally toward the head 82 of the holding means 81 by the feed piece 37*a* of the banding element feeder 37.

(f) Extracting Operation of the Assembly

To extract the assembly M′ in the feed part 35, the release lever 39 will be pushed in the direction indicated by the arrow "a", then the feed claw 40 moves in the direction indicated by the arrow "b" to disengage with the assembly M′, and thus the assembly M′ can be extracted easily.

As described in detail in the embodiments given above, the desired object can effectively be attained by the invention.

I claim:

1. A banding machine of the type adapted to support an assembly of banding elements which are individually served and fed for use, each banding element including a body with opposite ends which can be folded at a bending portion to interlock the opposite ends to form a closed band, the banding machine comprising a frame having a nose portion and having lever means for individual severed banding elements to the nose portion of said frame, said frame including a first guide groove formed therein, a stopper provided at the nose portion of said frame, and a first U-shaped clip having first and second legs supported in said frame at a selected position along said first guide groove, said first leg of said first U-shaped clip having a projection which is retractable when an individual severed banding element is moved toward said stopper and along said projection, said projection acting to hold the bending portion of said individual severed banding element in position to permit interlocking of said opposite ends of said banding element by said lever means.

2. The banding machine as claimed in claim 1, wherein said frame includes a second guide groove extending parallel to said first guide groove, and further comprising a second U-shaped clip positioned opposite said first U-shaped clip, said second U-shaped clip cooperating with said first U-shaped clip to hold the bending portion of the banding element in position during interlocking.

3. A banding machine of the type adapted to support an assembly of banding elements which are individually severed and fed for use, each banding element including a body with opposite ends which can be folded at a bending portion to interlock the opposite ends to form a closed band, the banding machine comprising a frame having a nose portion and having lever means for moving individual severed banding elements to the nose portion of said frame, said frame including a guide groove formed therein, feeder means for moving a severed banding element towards said guide groove, and an element support arm having a slit which receives said severed banding element from said feeder means, said element support arm including biasing means for biasing said element support arm towards said severed banding element.

* * * * *